US007536785B2

(12) United States Patent
Arakawa et al.

(10) Patent No.: US 7,536,785 B2
(45) Date of Patent: May 26, 2009

(54) METHOD FOR MANUFACTURING A DROPLET EJECTION HEAD

(75) Inventors: Katsuji Arakawa, Chino (JP); Yasutaka Matsumoto, Chino (JP)

(73) Assignee: Seiko Epson Corporation (JP)

( * ) Notice: Subject to any disclaimer, the term of this patent is extended or adjusted under 35 U.S.C. 154(b) by 292 days.

(21) Appl. No.: 11/295,758

(22) Filed: Dec. 7, 2005

(65) Prior Publication Data

US 2006/0118512 A1 Jun. 8, 2006

(30) Foreign Application Priority Data

Dec. 8, 2004 (JP) ..... 2004-354989

(51) Int. Cl.
*B21D 53/00* (2006.01)

(52) U.S. Cl. ..... 29/890.1; 29/25.35; 156/252; 156/292; 216/65; 216/66; 347/68; 347/70; 347/71

(58) Field of Classification Search ..... 29/25.35, 29/890.1; 156/252, 292; 216/65, 66; 347/68, 347/70, 71

See application file for complete search history.

(56) References Cited

U.S. PATENT DOCUMENTS

| | | | | |
|---|---|---|---|---|
| 6,569,343 | B1 | 5/2003 | Suzuki et al. | |
| 2003/0131475 | A1 * | 7/2003 | Conta | 29/890.1 |

FOREIGN PATENT DOCUMENTS

| | | |
|---|---|---|
| JP | 09-057981 | 3/1997 |
| JP | 11-028820 | 2/1999 |
| JP | 2001-071510 | 3/2001 |
| JP | 2005-225059 | 8/2005 |

* cited by examiner

*Primary Examiner*—Paul D Kim
(74) *Attorney, Agent, or Firm*—Harness, Dickey & Pierce, P.L.C.

(57) ABSTRACT

A method for manufacturing a droplet ejection head includes a step of forming recessed sections for forming nozzles by etching half way through a first face of a silicon substrate, a step of bonding a first support substrate to the first face of the silicon substrate, a step of reducing the thickness of the silicon substrate by processing a second face of the silicon substrate that is opposite to the first face thereof, and making the recessed sections through holes, and a step of removing the first support substrate from the silicon substrate after the reduction of the thickness of the silicon substrate.

10 Claims, 9 Drawing Sheets

(O)

(P)

(Q)

METHOD FOR MANUFACTURING A DROPLET EJECTION HEAD

The entire disclosure of Japanese Patent Application No. 2004-354989, filed Dec. 8, 2004, is expressly incorporated by reference herein.

BACKGROUND OF THE INVENTION

1. Field of the Invention

The present invention relates to methods for manufacturing droplet ejection heads, droplet ejection heads, and droplet ejection apparatuses. The present invention particularly relates to a method for manufacturing a droplet ejection head having high ejection performance with high yield, a droplet ejection head manufactured by the method, and a droplet ejection apparatus including the droplet ejection head.

2. Description of the Related Art

Inkjet recording apparatuses have many advantages: high-speed printing, low noise during printing, great freedom in the selection of ink, and the use of inexpensive plain paper. Among such inkjet recording apparatuses, the following apparatus has recently become mainstream: an ink-on-demand type inkjet recording apparatus for ejecting ink droplets only during printing. This type of inkjet recording apparatus has an advantage that the collection of unnecessary ink droplets is not necessary.

Examples of the ink-on-demand type inkjet recording apparatus include an electrostatic inkjet recording apparatus for ejecting ink droplets using static electricity, a piezoelectric inkjet recording apparatus including a piezo-element for driving, and a bubble jet® type inkjet recording apparatus including a heating element.

In these inkjet recording apparatuses, ink droplets are ejected from nozzles of inkjet heads. Arrangements of the nozzles are classified into two types: a side ejection type in which ink droplets are ejected from a side face of an inkjet head and a face ejection type in which ink droplets are ejected from the front face of an inkjet head.

In an inkjet head of the face ejection type, the thickness of a nozzle substrate is preferably adjusted by adjusting the flow resistance in nozzle channels such that nozzles have an optimum length.

Japanese Unexamined Patent Application Publication No. 9-57981 (hereinafter referred to as Patent Document 1) discloses a method for manufacturing a nozzle plate for known face ejection-type inkjet heads. In the method, after a silicon substrate is ground so as to have a desired thickness, first nozzle channels and second nozzle channels connected thereto are formed in the silicon substrate by etching both faces of the silicon substrate.

Japanese Unexamined Patent Application Publication No. 11-28820 (hereinafter referred to as Patent Document 2) discloses a method for forming nozzles for known face ejection-type ejectors (droplet ejection heads). In this method, first nozzle channels and second nozzle channels, connected thereto, having a diameter different from that of the first nozzle channels are formed in a first face of a silicon substrate by anisotropic dry etching using ICP discharge and a second face of the silicon substrate that is opposite to the first face thereof is then processed by anisotropic wet etching, whereby the length of the nozzles are adjusted.

In the method disclosed in Patent Document 1,there is a problem in that since the silicon substrate is ground so as to be reduced in thickness before the formation of the first and second nozzle channels by dry etching, the silicon substrate is cracked or chipped during manufacturing steps. This leads to a reduction in yield, resulting in an increase in manufacturing cost.

Furthermore, in this method, there is a problem in that since a face of the nozzle plate that is opposite to a processed face thereof is cooled using a helium gas or another gas during dry etching such that the nozzle plate can be accurately processed, the helium gas flows to the processed face from the opposite face at the point of time when any nozzle penetrates the nozzle plate, whereby etching is prevented.

In general, the inner walls of nozzles must be covered with ink-resistant protective layers made of silicon dioxide. However, in this method, there is a problem in that since the silicon substrate has a small thickness and is therefore readily distorted due to its weight, the silicon substrate cannot be set in a thermal oxidation system for forming an ink-resistant protective layer by thermal oxidation. Furthermore, if the ink-resistant protective layer is formed by chemical vapor deposition (CVD) or sputtering, in which the heat load is low, instead of thermal oxidation, the ink-resistant protective layer cannot be uniformly formed over the walls of the nozzles.

In the method disclosed in Patent Document 2,there is a problem in that since an ejection face in which openings of the first nozzle channels are arranged is located back from the front face of the substrate, droplets fly in curved paths. Furthermore, there is a problem in that the following operation cannot be readily performed due to its configuration: a wiping operation for removing paper or ink dust, which causes nozzle plugging from the ejection face with a piece of rubber or felt.

SUMMARY

It is an object of the present invention to provide a method for manufacturing a droplet ejection head with high yield, the droplet ejection head being prevented from being cracked or chipped during manufacturing steps; a droplet ejection head, manufactured by the method, having high ejection performance; and a droplet ejection apparatus, including the droplet ejection head, having high printing performance.

A method for manufacturing a droplet ejection head according to the present invention includes a step of forming recessed sections for forming nozzles by etching a first face of a silicon substrate, a step of bonding a support substrate to the first face of the silicon substrate, a step of reducing the thickness of the silicon substrate by processing a second face of the silicon substrate that is opposite to the first face thereof, and a step of removing the support substrate from the silicon substrate after the reduction of the thickness of the silicon substrate.

Since the recessed sections are formed by etching the first face of the silicon substrate, the support substrate is bonded to the first face of the silicon substrate, and the thickness of the silicon substrate is then reduced by processing the second face of the silicon substrate that is opposite to the first face thereof, the silicon substrate may have a large thickness when the recessed sections are formed; hence, the silicon substrate can be prevented from being cracked or chipped. The method includes no step of processing the silicon substrate of which the thickness has been reduced; hence, the silicon substrate can be effectively prevented from being cracked or chipped.

Furthermore, if the recessed sections are formed in the silicon substrate having a large thickness so as not to extend through the silicon substrate, a helium gas or another gas can be prevented from leaking to a processed face and etching failure can therefore be prevented.

In the method, the step of recessed sections preferably includes a sub-step of forming recessed sections for forming first nozzle channels and a sub-step of forming recessed sections for forming second nozzle channels, each connected to the corresponding first nozzle channels, having a diameter greater than that of the first nozzle channels.

If the first nozzle channels are so formed as to extend on an ejection face side, and the second nozzle channels, each connected to the corresponding first nozzle channels, having a diameter greater than that of the first nozzle channels are so formed as to extend on an ejection chamber side, nozzles each having two different diameters can be formed. This allows droplets to fly straight.

In the method, the recessed sections for forming the nozzles are preferably formed by dry etching.

If the recessed sections for forming the nozzles are formed by dry etching, the nozzles can be precisely formed in a short time.

The method may further include a step of forming a silicon dioxide layer over the silicon substrate by thermal oxidation, this step being performed prior to the bonding step.

If the silicon dioxide layer is formed over the silicon substrate by thermal oxidation before the support substrate is bonded to the silicon substrate, the silicon dioxide layer can be uniformly formed over the walls of the nozzles; hence, the droplet ejection head can be manufactured so as to have high ejection performance.

In the method, the step of reducing the thickness of the silicon substrate preferably includes a sub-step of dry-etching the silicon substrate such that the nozzles penetrate the silicon substrate.

If the thickness of the silicon substrate is reduced by grinding and the silicon substrate is then dry-etched in the final sub-step of the step of reducing the thickness of the silicon substrate such that the nozzles penetrate the silicon substrate, the peripheries of the nozzles can be prevented from being damaged.

In the method, the step of reducing the thickness of the silicon substrate preferably includes a sub-step of processing the silicon substrate by chemical mechanical polishing (CMP) such that the nozzles penetrate the silicon substrate.

If the thickness of the silicon substrate is reduced by grinding and the silicon substrate is processed by CMP in the final sub-step of the step of reducing the thickness of the silicon substrate such that the nozzles penetrate the silicon substrate, the peripheries of the nozzles can be prevented from being damaged.

The method may further include a step of forming an ink-resistant protective layer and an ink-repellent layer on the second face of the silicon substrate, this step being performed subsequent to the step of reducing the thickness of the silicon substrate.

If the ink-resistant protective layer and the ink-repellent layer are formed on the second face (ejection face) of the silicon substrate, the droplet ejection head can be protected from being etched by ink droplets or the like. This allows such droplets to fly straight.

In the method, the ink-resistant protective layer is preferably formed by room-temperature sputtering.

If the ink-resistant protective layer is formed by room-temperature sputtering, a resin layer, used to combine the silicon substrate and the support substrate together, having low heat resistance can be prevented from being deteriorated.

The method may further include a step of bonding a second support substrate or a tape to the second face of the silicon substrate and a step of removing the support substrate from the silicon substrate in such a state that the second support substrate or the tape is bonded to the silicon substrate.

If the support substrate is removed from the silicon substrate in such a state that the second support substrate or the tape is bonded to the second face of the silicon substrate, the silicon substrate can be prevented from being damaged during the plasma treatment of the walls of the nozzles or during the bonding of the silicon substrate to a cavity substrate.

In the method, the walls of the nozzles are preferably plasma-treated in such a state that the second support substrate or the tape is bonded to the silicon substrate.

If the ink repellent layer is partly removed by plasma-treating the walls of the nozzles, the performance of ejecting ink is enhanced. If the walls of the nozzles are plasma-treated in such a state that the second support substrate or the tape is bonded to the silicon substrate, only portions of the ink repellent layer that are present on the inner walls of the nozzles can be removed without removing portions of the ink repellent layer that are present on the ejection face.

The method may further include a step of bonding the silicon substrate to a cavity substrate having recessed sections for forming ejection chambers in such a state that the second support substrate or the tape is bonded to the silicon substrate and a step of removing the second support substrate or the tape from the silicon substrate bonded to the cavity substrate.

If the silicon substrate is bonded to the cavity substrate in such a state that the second support substrate or the tape is bonded to the silicon substrate, the silicon substrate can be prevented from being damaged because the silicon substrate reduced in thickness is supported with the second support substrate or the tape.

A method for manufacturing a droplet ejection head according to the present invention includes a step of forming recessed sections for forming nozzles by etching a first face of a silicon substrate, a step of bonding a first support substrate to the first face of the silicon substrate, a step of reducing the thickness of the silicon substrate by processing a second face of the silicon substrate that is opposite to the first face thereof, a step of bonding a second support substrate or a tape to the second face of the silicon substrate, and a step of removing the first support substrate from the silicon substrate in such a state that the second support substrate or the tape is bonded to the silicon substrate.

Since the silicon substrate bonded to the second support substrate or the tape is bonded to the cavity substrate, the silicon substrate can be prevented from being cracked or chipped. Other advantages of this method are substantially the same as those of the former method.

In this method, the walls of the nozzles are preferably plasma-treated in such a state that the second support substrate or the tape is bonded to the silicon substrate.

If the ink repellent layer is partly removed by plasma-treating the walls of the nozzles, the performance of ejecting ink is enhanced. If the walls of the nozzles are plasma-treated in such a state that the second support substrate or the tape is bonded to the silicon substrate, only portions of the ink repellent layer that are present on the walls of the nozzles can be removed without removing portions of the ink repellent layer that are present on the ejection face.

This method may further include a step of bonding the silicon substrate to a cavity substrate having recessed sections for forming ejection chambers in such a state that the second support substrate or the tape is bonded to the silicon substrate and a step of removing the second support substrate or the tape from the silicon substrate bonded to the cavity substrate.

If the silicon substrate is bonded to the cavity substrate in such a state that the second support substrate or the tape is bonded to the silicon substrate, the silicon substrate can be prevented from being damaged because the silicon substrate reduced in thickness is supported with the second support substrate or the tape.

A droplet ejection head according to the present invention is manufactured by any one of the above methods.

Since any one of the methods is used, the droplet ejection head has no cracks or defects but high ejection performance.

A droplet ejection apparatus according to the present invention includes the droplet ejection head.

Since the droplet ejection apparatus includes the droplet ejection head, the droplet ejection apparatus has high printing performance and the like.

DESCRIPTION OF THE PREFERRED EMBODIMENTS

First Embodiment

Figure 1:
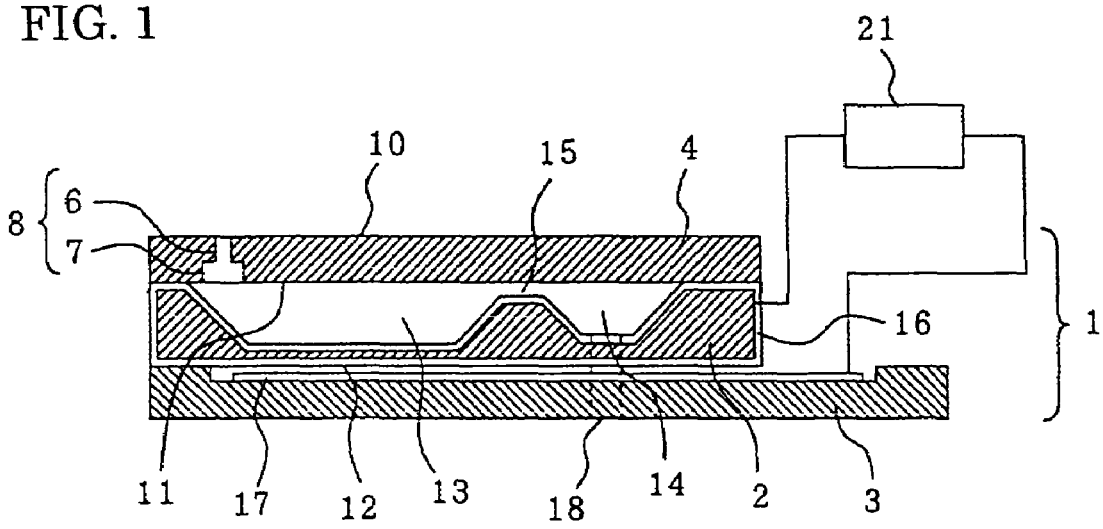
FIG. 1 is a vertical sectional view of a droplet ejection head according to a first embodiment of the present invention.

FIG. 1 is a vertical sectional view of a droplet ejection head according to a first embodiment of the present invention, in which a driving circuit 21 is shown schematically. The droplet ejection head shown in FIG. 1 is an example of an electrostatic droplet ejection apparatus of a face ejection type.

With reference to FIG. 1, reference numeral 1 represents the droplet ejection head. The droplet ejection head 1 principally includes a cavity substrate 2, an electrode substrate 3, and a nozzle substrate 4. The electrode substrate 3 and the nozzle substrate 4 are bonded to the cavity substrate 2. The nozzle substrate 4 is made of silicon and has nozzles 8 each having corresponding first nozzle channels 6 and second nozzle channels 7, connected to the first nozzle channels 6, having a diameter greater than that of the first nozzle channels 6. The first and second nozzle channels 6 and 7 have, for example, a cylindrical shape. The nozzle substrate 4 has a droplet ejection face 10 and a joint face 11 which is opposite to the droplet ejection face 10 and which is bonded to the cavity substrate 2. The first nozzle channels 6 each have corresponding openings arranged in the droplet ejection face 10 and the second nozzle channels 7 each have corresponding openings arranged in the joint face 11.

The nozzle substrate 4 is preferably made of single-crystalline silicon because the nozzle substrate 4 can be readily processed in preparation steps below.

The cavity substrate 2 is made of, for example, single-crystalline silicon and has a plurality of recessed portions for forming ejection chambers 13 and includes a plurality of vibrating plates 12 that are the bottoms of the ejection chambers 13. The ejection chambers 13 are arranged perpendicularly to the plane of FIG. 1 in parallel to each other. The cavity substrate 2 further has a recessed portion for forming a reservoir 14 for supplying ink to the ejection chambers 13 and recessed portions, having a narrow groove shape, for forming orifices 15 for connecting the reservoir 14 to the ejection chambers 13. The droplet ejection head 1 shown in FIG. 1 includes the single reservoir 14. The orifices 15 are each connected to the corresponding ejection chambers 13. The orifices 15 may be arranged in the joint face 11 to the nozzle substrate 4.

The cavity substrate 2 is entirely covered with an insulating layer 16 (corresponding to a droplet protection layer 24 described below), made of silicon dioxide or the like, formed by, for example, CVD or thermal oxidation. The insulating layer 16 prevents dielectric breakdown and/or short circuiting during the operation of the droplet ejection head 1 and protects the cavity substrate 2 from being etched by the ink stored in the ejection chambers 13 or the reservoir 14.

The electrode substrate 3 is made of, for example, borosilicate glass and is bonded to a face of the cavity substrate 2 that have the vibrating plates 12. The electrode substrate 3 includes a plurality of electrodes 17 opposed to the vibrating plates 12. The electrodes 17 are made of indium tin oxide (ITO) and can be formed by sputtering. The electrode substrate 3 has an ink supply channel 18 connected to the reservoir 14. In particular, the ink supply channel 18 is connected to a hole located at the bottom of the reservoir 14 and used to supply the ink to the reservoir 14 from outside.

When the cavity substrate 2 is made of single-crystalline silicon and the electrode substrate 3 is made of borosilicate glass, the cavity substrate 2 can be bonded to the electrode substrate 3 by anodic bonding.

The operation of the droplet ejection head 1 shown in FIG. 1 will now be described. The cavity substrate 2 and the electrodes 17 are connected to the driving circuit 21. When a pulse voltage is applied between the cavity substrate 2 and the electrodes 17 with the driving circuit 21, the vibrating plates 12 are warped toward the electrodes 17, whereby the ink stored in the reservoir 14 is supplied to ejection chambers 13. When no voltage is applied between the cavity substrate 2 and the electrodes 17, the vibrating plates 12 are returned to their original state. This increases the pressure in the ejection chambers 13 to eject droplets of the ink from the nozzles 8.

In this embodiment, the droplet ejection head 1 is of an electrostatic type; however, steps of preparing the nozzle substrate 4 described in this embodiment can be used to manufacture droplet ejection heads of a piezoelectric type, a bubble jet® type, or another type.

Figure 2:
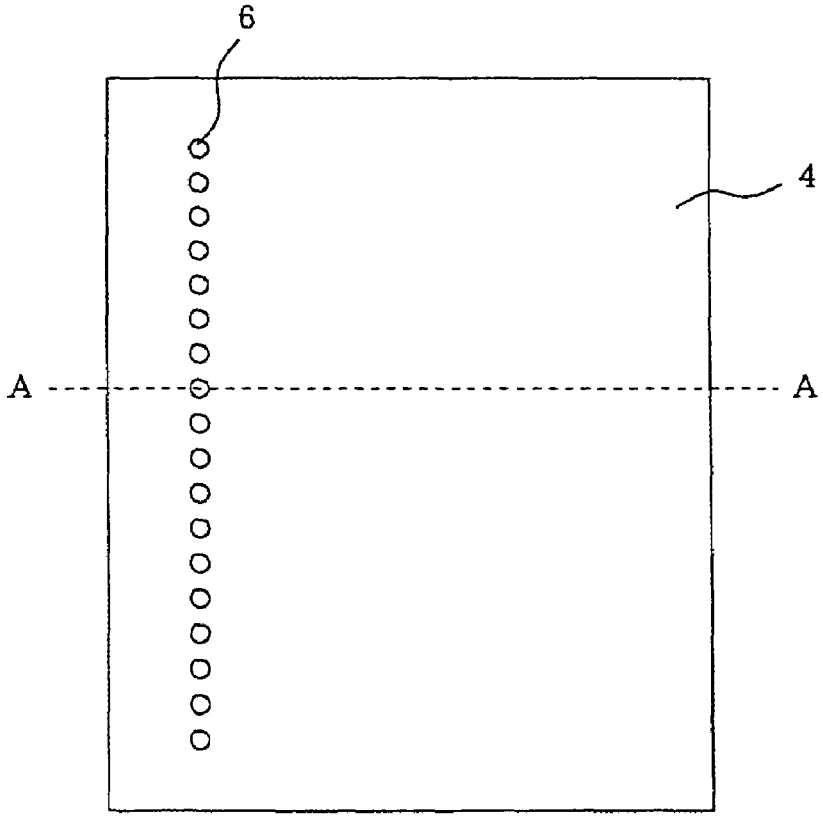
FIG. 2 is a top view of a nozzle substrate viewed from a droplet ejection face.

FIG. 2 is a top view of the nozzle substrate 4 viewed from the droplet ejection face 10. With reference to FIG. 2, the openings of the first nozzle channels 6 are arranged in the droplet ejection face 10 of the nozzle substrate 4. The second nozzle channels 7 each extend from the corresponding first nozzle channels 6 in the direction away from the plane of FIG. 2. The ejection chambers 13 are each connected to the corresponding first nozzle channels 6 (the nozzles 8), have a narrow shape, and extend in parallel to the line A-A of FIG. 2.

In this embodiment, the steps of preparing the nozzle substrate 4 are principally described below. In the droplet ejection head 1, the centers of the first nozzle channels 6 are each precisely aligned with those of the corresponding second nozzle channels 7. This allows the ink droplets ejected from the nozzles 8 to fly straight.

Figure 6:
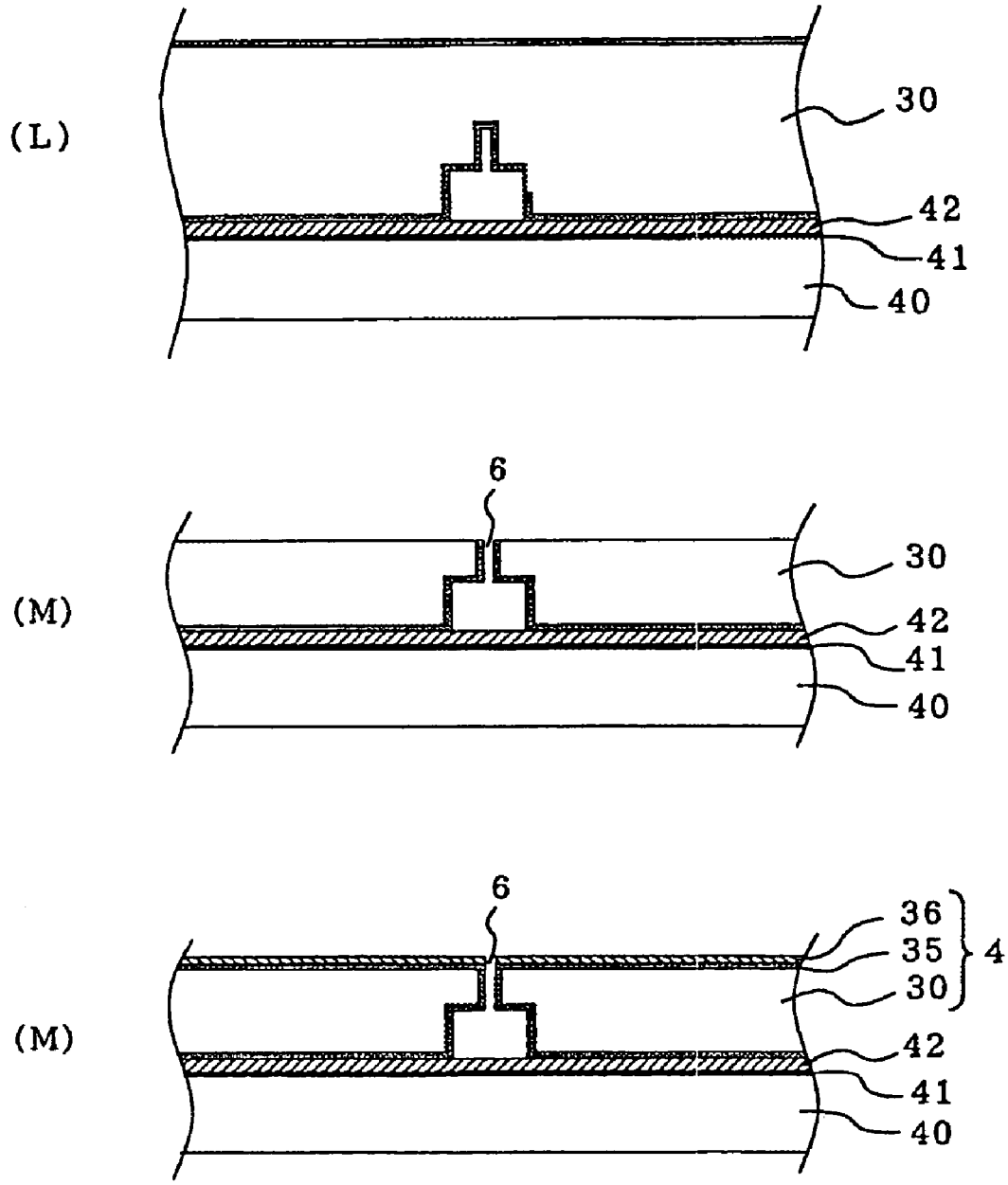
FIGS. 6L to 6N are vertical sectional views showing steps subsequent to the step shown in FIG. 5K.
Figure 7:
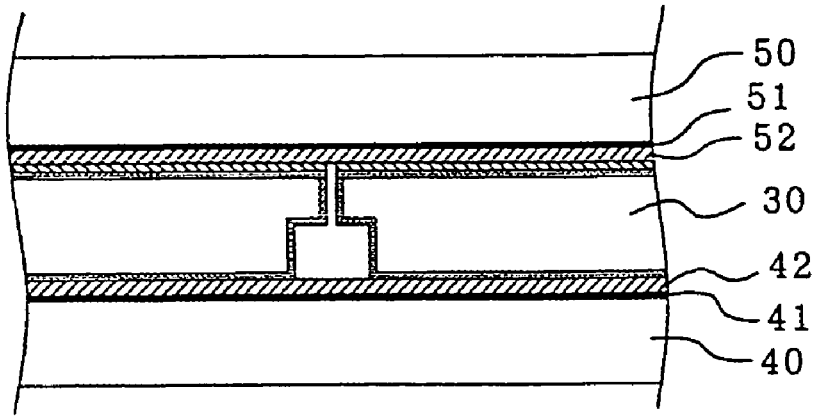
FIGS. 7O to 7Q are vertical sectional views showing steps subsequent to the step shown in FIG. 6N.
Figure 7:
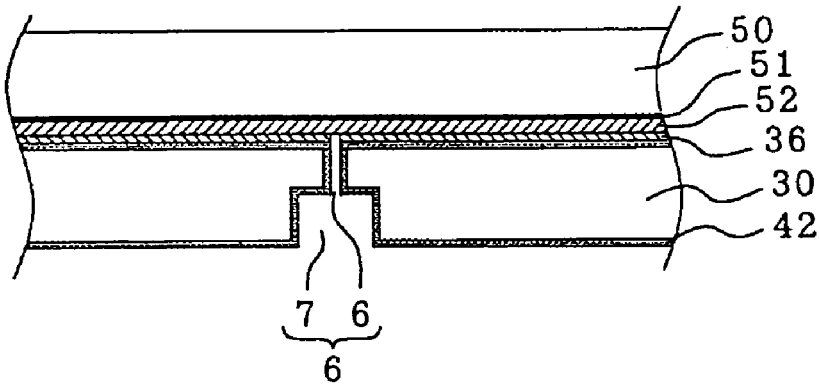
Figure 7:
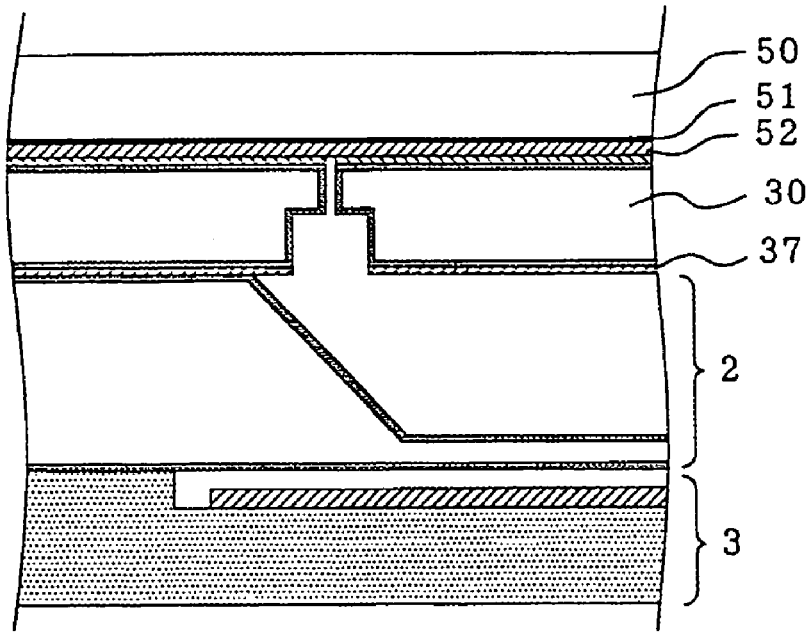
Figure 8:
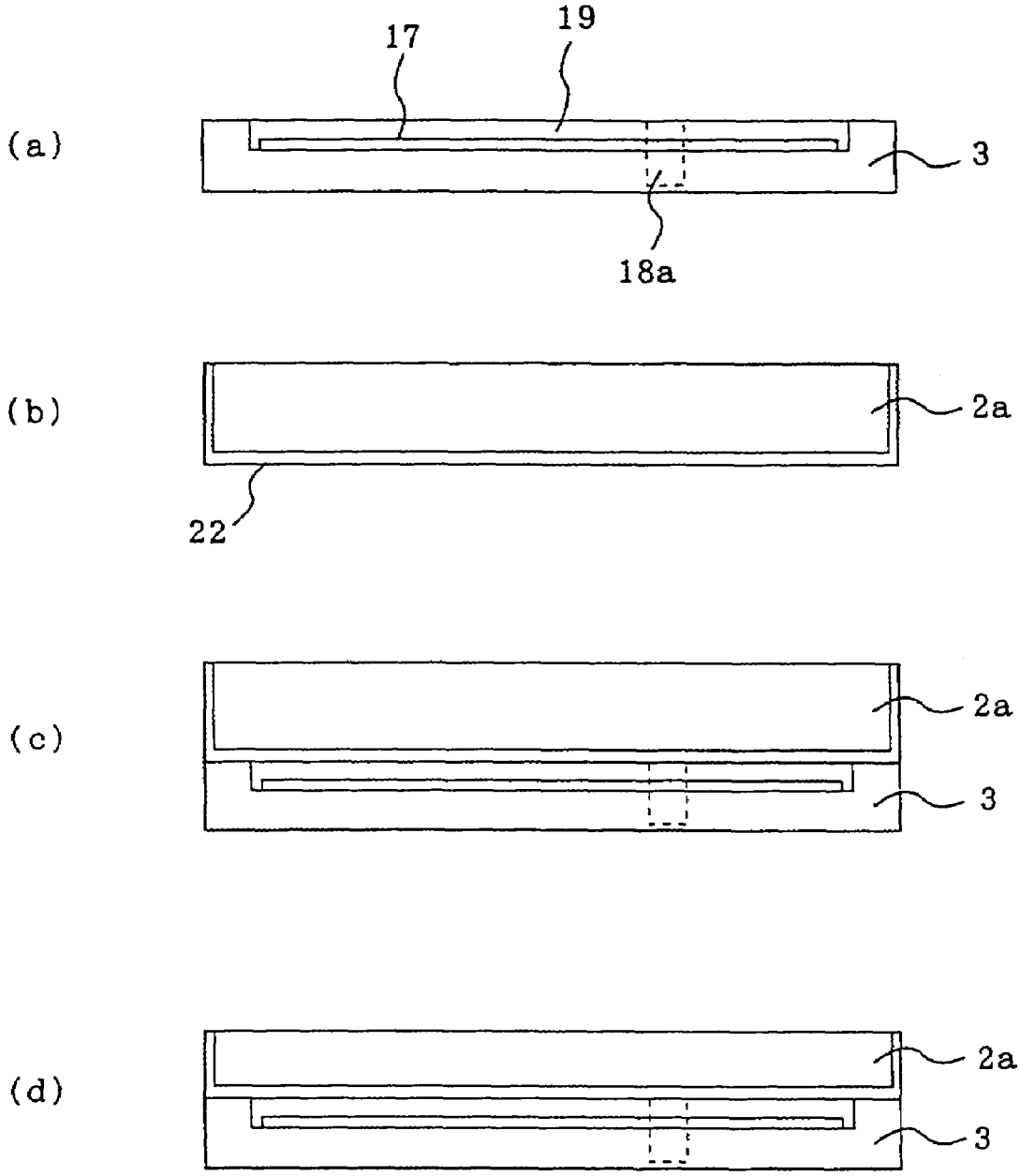
FIGS. 8A to 8D are vertical sectional views showing steps of preparing a composite plate including a cavity substrate and electrode substrate bonded to each other.
Figure 9:
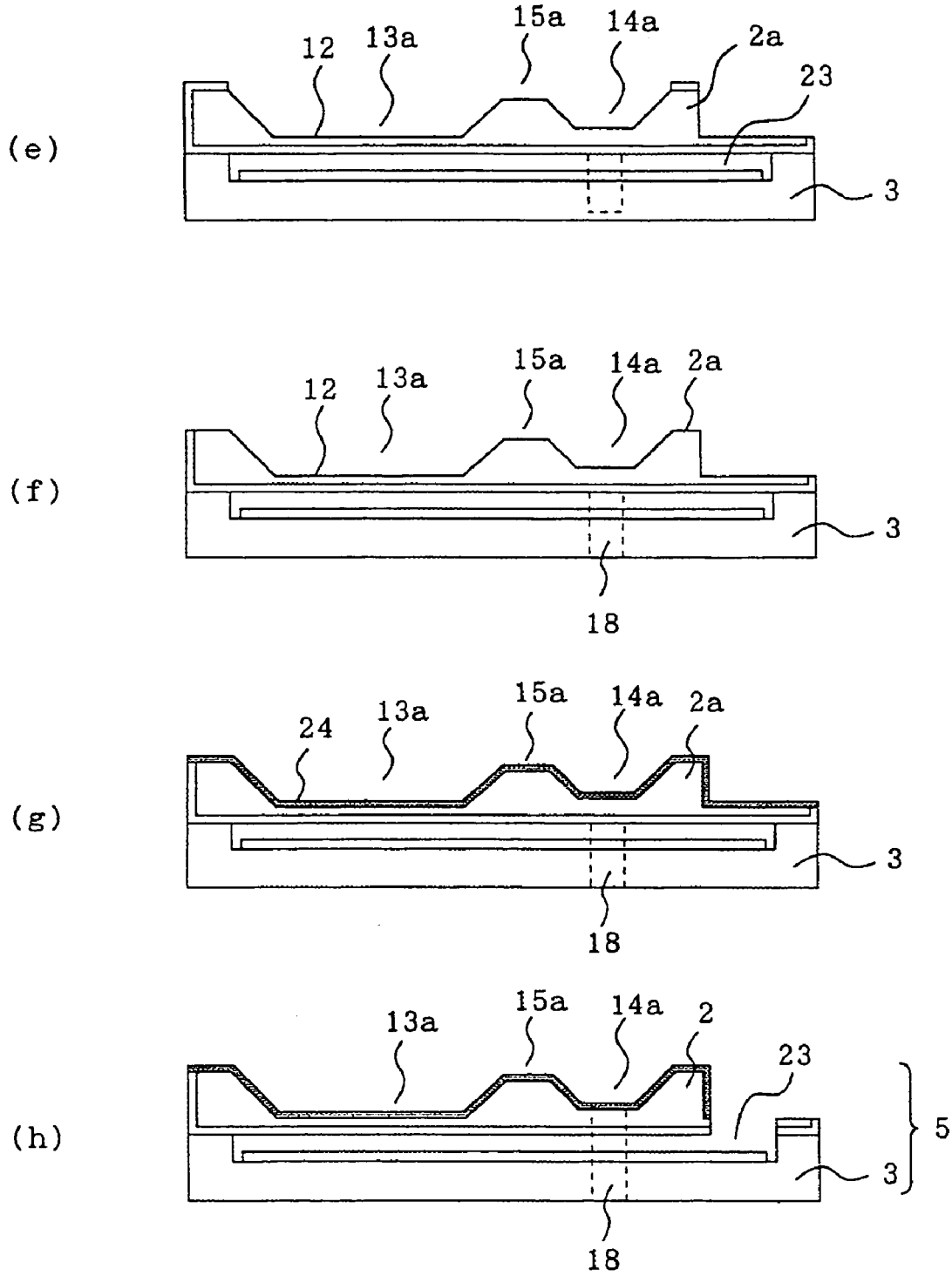
FIGS. 9E to 9H are vertical sectional views showing steps subsequent to the step shown in FIG. 8D.

FIGS. 3 to 9 are vertical sectional views illustrating steps of manufacturing the droplet ejection head 1 according to this embodiment. FIGS. 3 to 7 principally illustrate the steps of preparing the nozzle substrate 4 and FIGS. 8 and 9 illustrate steps of preparing a composite plate 5 including the cavity substrate 2 and electrode substrate 3 bonded to each other. FIGS. 3 to 7 show one of the nozzles 8 and the periphery thereof in cross section taken along the line A-A of FIG. 2. The steps of manufacturing the droplet ejection head 1 are described as follows: steps of processing a first silicon substrate 30 into the nozzle substrate 4 are describe with reference to FIGS. 3 to 7 and steps of bonding the nozzle substrate 4 to the composite plate 5 are then described.

As shown in FIG. 3A, the first silicon substrate 30 with a thickness of, for example, 525 μm is prepared and a first silicon dioxide layer 31 is uniformly formed over the first silicon substrate 30. The first silicon dioxide layer 31 can be formed with, for example, a thermal oxidation system in such a manner that the first silicon substrate 30 is thermally oxidized in an atmosphere containing oxygen and steam at 1075° C. for four hours.

As shown in FIG. 3B, a first resist coating 32 is provided above a first face of the resulting first silicon substrate 30 and then patterned, whereby the first resist coating 32 is partly removed such that first sections 7*a* for forming the second nozzle channels 7 are formed. The first face of the silicon substrate 30 that have the first resist coating 32 is to be processed into the joint face 11 of the nozzle substrate 4 as described later.

As shown in FIG. 3C, the first silicon dioxide layer 31 is half-etched with an aqueous buffer solution prepared by mixing one part of an aqueous hydrofluoric acid solution and six parts of an aqueous ammonium fluoride solution, whereby portions of the first silicon dioxide layer 31 that are located under the first sections 7*a* are reduced in thickness. In this step, other portions of the first silicon dioxide layer 31 that are not covered with the first resist coating 32 is also reduced in thickness.

As shown in FIG. 3D, the first resist coating 32 is then removed from the first silicon dioxide layer 31.

As shown in FIG. 4E, a second resist coating 33 is provided above the first face of the first silicon substrate 30 and then patterned, whereby the second resist coating 33 is partly removed such that second sections 6*a* for forming the first nozzle channels 6 are formed.

As shown in FIG. 4F, the first silicon dioxide layer 31 is half-etched with the aqueous buffer solution, whereby portions of the first silicon dioxide layer 31 that are located under the second sections 6*a* are removed. In this step, other portions of the first silicon dioxide layer 31 that are not covered with the second resist coating 33 are entirely removed.

As shown in FIG. 4G, the second resist coating 33 formed in the step shown in FIG. 4E is removed.

As shown in FIG. 4H, portions of the first silicon substrate 30 that are located under the second sections 6*a* are anisotropically dry-etched by inductively coupled plasma (ICP) discharge, whereby first recessed sections 6*b* with a depth of, for example, 25 μm are formed. The first recessed sections 6*b* are to be processed into third recessed sections 6*c* for forming the first nozzle channels 6 as shown in FIG. 5J. In this anisotropic dry etching operation, $C_4F_8$ and $SF_6$ may be alternately used. $C_4F_8$ is used to protect the walls of the first recessed sections 6*b* from being etched and $SF_6$ is used to etch the first silicon substrate 30 such that the first recessed sections 6*b* extend in the vertical direction.

As shown in FIG. 5I, the first silicon dioxide layer 31 is half-etched, whereby the first sections 7*a* of the first silicon dioxide layer 31 are removed. In this step, other portions of the first silicon dioxide layer 31 are reduced in thickness.

As shown in FIG. 5J, portions of the first silicon substrate 30 (including the first recessed sections 6*b*) that are located under the first sections 7*a* are anisotropically dry-etched by ICP discharge, whereby second recessed sections 7*b*,having a depth of about 40 μm, for forming the second nozzle channels 7 and the third recessed sections 6*c* are formed.

As shown in FIG. 5K, the first silicon dioxide layer 31 remaining on the first silicon substrate 30 is entirely removed with, for example, an aqueous hydrofluoric acid solution and a second silicon dioxide layer 34 with a thickness of, for example, 0.1 μm is uniformly formed over the first silicon substrate 30. The second silicon dioxide layer 34 can be formed with, for example, a thermal oxidation system in such a manner that the first silicon substrate 30 is thermally oxidized in an oxygen atmosphere at 1000° C. for two hours. In the step shown in FIG. 5K, the second silicon dioxide layer 34 can be uniformly formed over the walls of the third and second recessed sections 6*c* and 7*b*.

Figure 3:
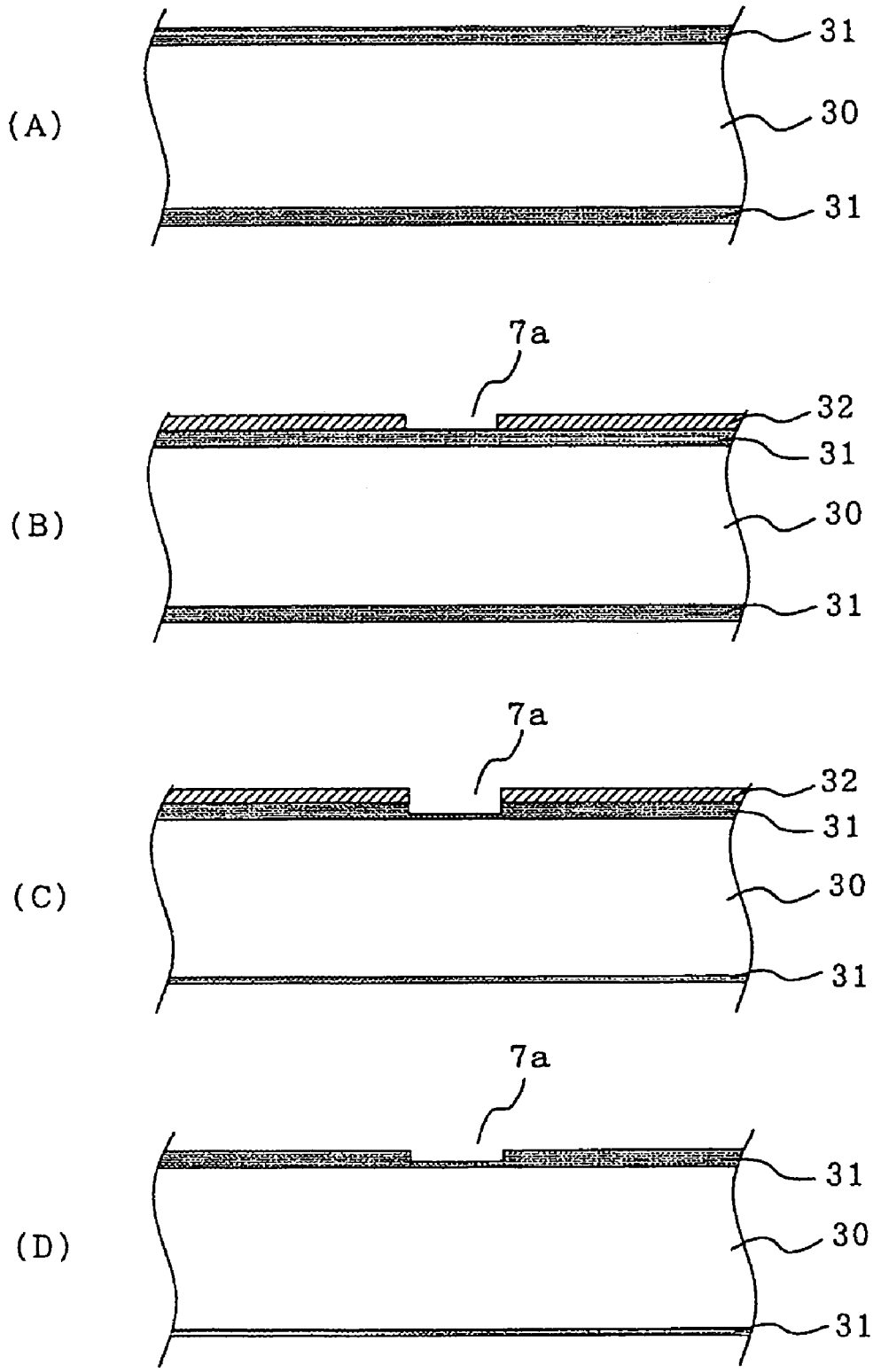
FIGS. 3A to 3D are vertical sectional views showing steps of preparing the nozzle substrate according to the first embodiment.
Figure 4:
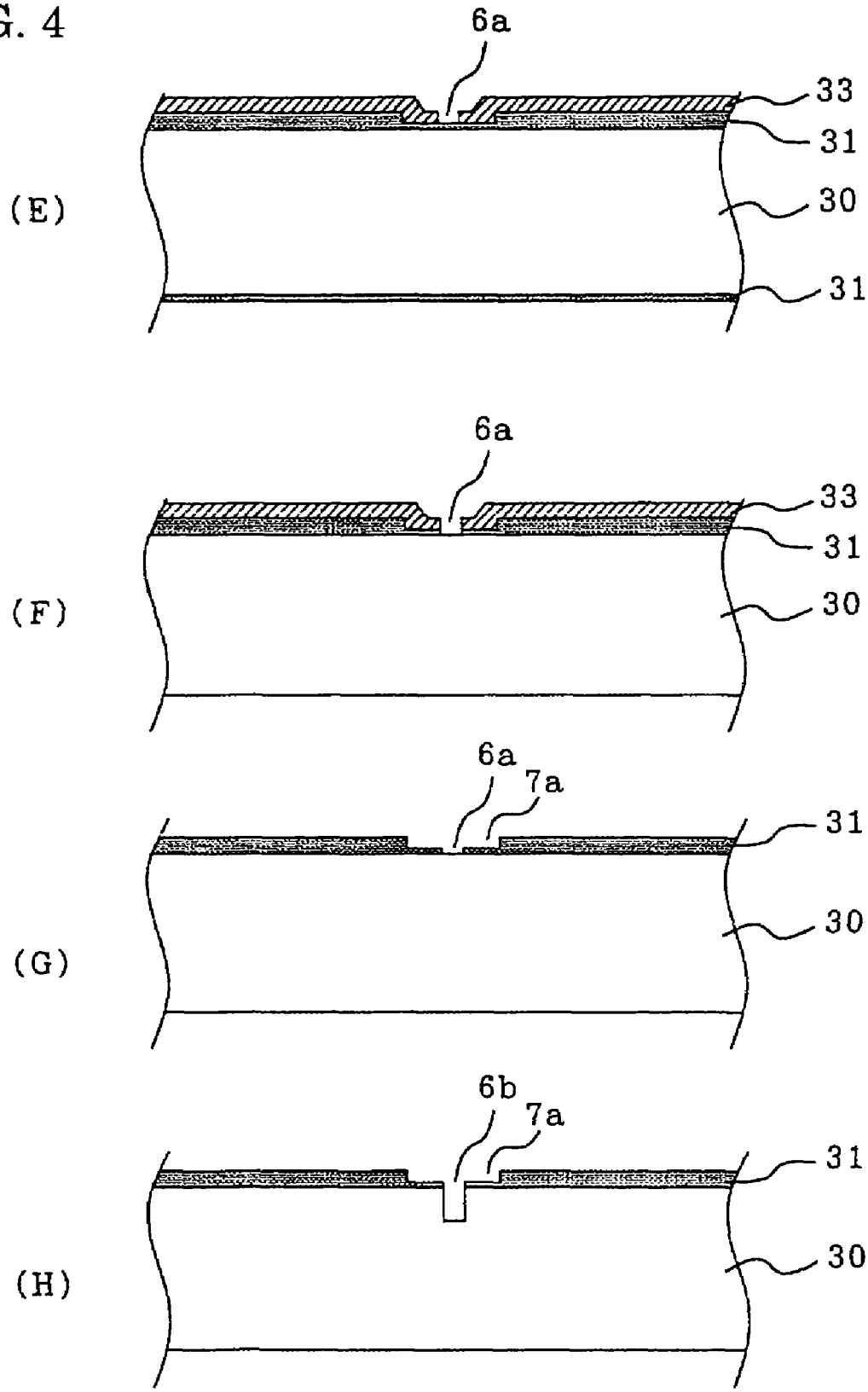
FIGS. 4E to 4H are vertical sectional views showing steps subsequent to the step shown in FIG. 3D.
Figure 5:
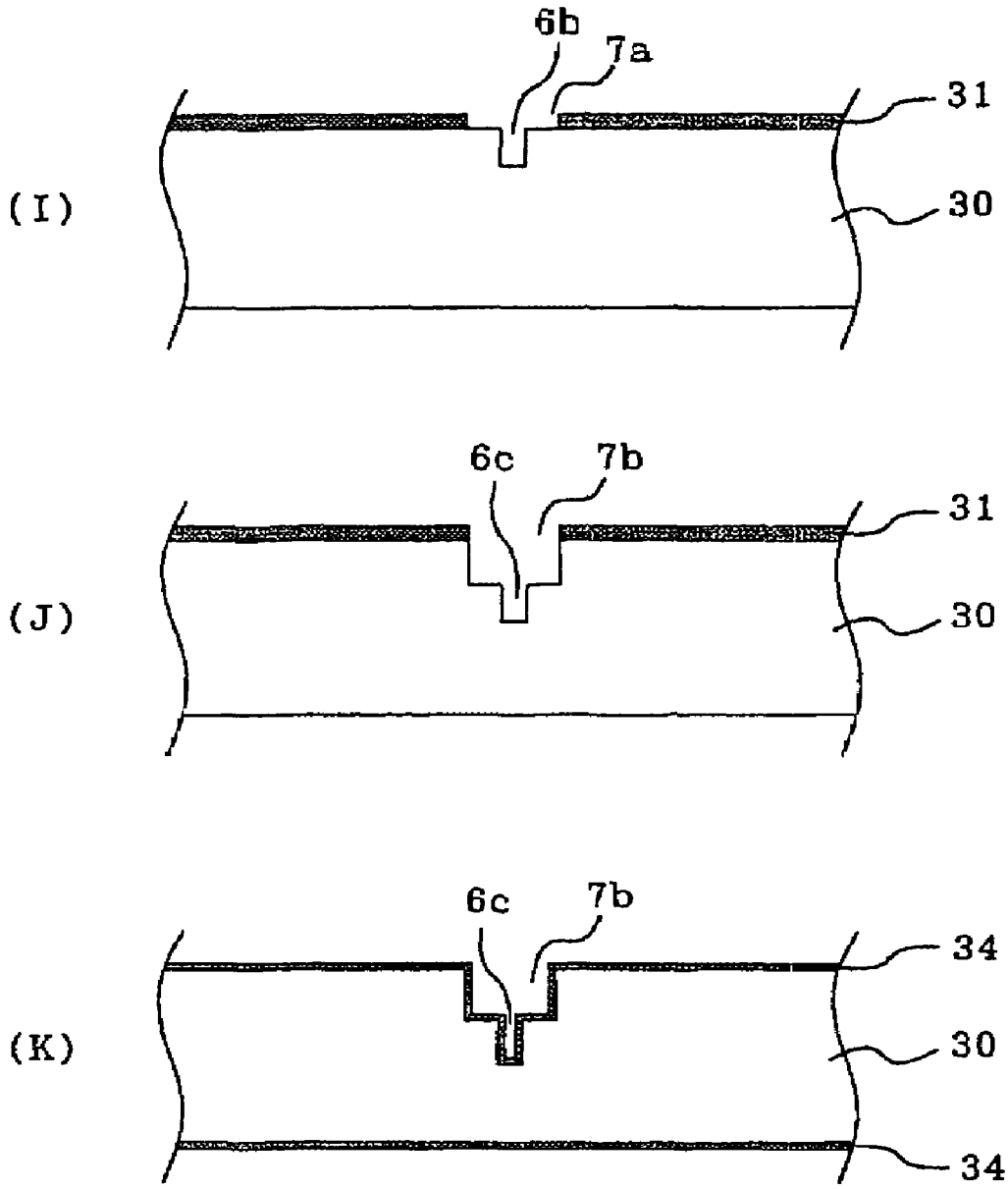
FIGS. 5I to 5K are vertical sectional views showing steps subsequent to the step shown in FIG. 4H.

A first support substrate 40 made of a transparent material, for example, glass is prepared. A first release layer 41 and a first resin layer 42 are formed on a first face of the first support substrate 40 by spin coating in that order. As shown in FIG. 6L, the first resin layer 42 is pressed against the first face of the first silicon substrate 30 that has the second recessed sections 7*b* and then cured, whereby the first support substrate 40 is bonded to the first silicon substrate 30. The first silicon substrate 30 shown in FIGS. 3 to 5 is shown in FIGS. 6 and 7 in an upside down manner.

The first release layer 41 and resin layer 42 treated in the step shown in FIG. 6L are described below.

When the first release layer 41 is irradiated with a light beam such as a laser beam, failure (referred to as intra-layer failure or interfacial failure) occurs in the first release layer 41 or the interface between the first release layer 41 and the first support substrate 40 (see FIG. 7). That is, when the first release layer 41 is irradiated with light with an intensity greater than a certain value, bonds between atoms or molecules contained in the first release layer 41 are weakened or broken. This causes ablation. Components of the first release layer 41 are vaporized by applying light with an intensity greater than a certain value to the first release layer 41; hence, failure occurs. This allows the first support substrate 40 to be released from the first silicon substrate 30 (the nozzle substrate 4) reduced in thickness in a subsequent step shown in FIG. 7P.

The first support substrate 40 is preferably made of a transparent material such as glass. This is because when the first support substrate 40 is separated from the first silicon substrate 30, the first release layer 41 can be irradiated with a light beam by applying the light beam to a second face of the first support substrate 40 that is opposite to the first face of the first support substrate 40 such that an energy sufficient to release the first release layer 41 is applied to the first release layer 41.

A material for forming the first release layer 41 is not particularly limited and any material having the above function can be used. Examples of such a material include amorphous silicon (a-Si); silicon compounds such as silicon dioxide; nitride ceramics such as silicon nitride, aluminum nitride, and titanium nitride; organic polymers in which atomic bonds can be broken by light irradiation; metals such as aluminum, lithium, titanium, manganese, indium, tin, yttrium, lanthanum, cerium, neodymium, praseodymium, gadolinium, and samarium; and alloys containing at least one of these metals. Among these materials, amorphous silicon is preferably used to form the first release layer 41. In particular, amorphous silicon containing hydrogen is more preferable. This is because if the first release layer 41 is made of amorphous silicon containing hydrogen, hydrogen gas is generated in the first release layer 41 when the first release layer 41 is irradiated with light; hence, the pressure in the first release layer 41 allows the first support substrate 40 to be released from the first silicon substrate 30. The first release layer 41 preferably has a hydrogen content of 2% or more and more preferably 2% to 20% on a weight basis.

The first resin layer 42 covers irregularities of the first silicon substrate 30 and bonds the first silicon substrate 30 to the first support substrate 40. A material for forming the first resin layer 42 is not particularly limited and any material that can bond the first silicon substrate 30 to the first support substrate 40 can be used. Examples of such a material include curable adhesives such as a heat-curable adhesive and a photocurable adhesive. The first resin layer 42 preferably has high dry etching resistance.

In this embodiment, the first release layer 41 and the first resin layer 42 are used; however, a single layer having the same functions as those of the first release layer 41 and the first resin layer 42 may be used. For example, a layer having the following functions can be used: a function of bonding the first silicon substrate 30 to the first support substrate 40 and a function of releasing the first support substrate 40 from the first silicon substrate 30 by photo-energy or heat energy. A material having these functions is disclosed in, for example, Japanese Unexamined Patent Application Publication No. 2002-373871.

With reference back to the step shown in FIG. 6L, after the first support substrate 40 is bonded to the first face of the first silicon substrate 30, a second face of the first silicon substrate 30 that is opposite to the first face thereof is ground, whereby the first silicon substrate 30 is reduced in thickness such that the third recessed sections 6*c* almost appear on the ground face. As shown in FIG. 6M, the first silicon substrate 30 is dry-etched with an etching gas such as $CF_4$ or $CHF_3$ such that portions of the second silicon dioxide layer 34 that are located on the third recessed sections 6*c* are removed. This allows the nozzles 8 to penetrate the first silicon substrate 30. In order to allow the nozzles 8 to penetrate the first silicon substrate 30, the portions of the second silicon dioxide layer 34 that are located on the third recessed sections 6*c* may be removed with a CMP machine; however, an abrasive, used for CMP, remaining in the nozzles 8 must be removed. Therefore, dry etching is preferably performed. Furthermore, in order to reduce the thickness of the first silicon substrate 30, an etching gas such as $SF_6$ may be used.

An ink-resistant protective layer 35 made of silicon dioxide is formed on the second face of the first silicon substrate 30 with-a sputtering system. Examples of such a sputtering system include a room-temperature sputtering system such as an electron cyclotron resonance (ECR) sputtering system. The ECR sputtering system is preferably used because the ink-resistant protective layer 35 formed therewith is dense and the first resin layer 42 can be prevented from being deteriorated due to heat. The ink-resistant protective layer 35 may be formed with another type of sputtering system or another process if the first resin layer 42 can be maintained at a low temperature, for example, 200° C. or less, such that the first resin layer 42 is prevented from being deteriorated due to heat.

As shown in FIG. 6N, an ink-repellent layer. 36 is formed on the ink-resistant protective layer 35 by vapor deposition, dipping, or another technique. The ink-repellent layer 36 may be made of an ink-repellent material containing fluorine. In this step, the processing of the first silicon substrate 30 is finished, that is, the nozzle substrate 4 is completed.

In the same manner as that of the step shown in FIG. 6L, a second support substrate 50 made of, for example, a transparent material such as glass is prepared and a second release layer 51 and a second resin layer 52 are formed on a first face of the second support substrate 50 by spin coating in that order. As shown in FIG. 7O, the second resin layer 52 is pressed against the second face of the first silicon substrate 30 and then cured, whereby the second support substrate 50 is bonded to the first silicon substrate 30. The first release layer 41 is irradiated with a laser beam or the like by applying the laser beam or the like to the first support substrate 40, whereby the first support substrate 40 is released from the first release layer 41. The first resin layer 42 is then carefully peeled off from the first silicon substrate 30. In this operation, an outer portion of the first resin layer 42 is first peeled off and the first resin layer 42 is then entirely peeled off from the first silicon substrate 30.

As shown in FIG. 7P, pieces of the ink-repellent layer 36 that remain on the walls of the first and second nozzle channels 6 and 7 are removed by plasma-treating from the side of the second nozzle channels 7. The ink-repellent layer pieces remaining thereon have been formed in the step of forming the ink-repellent layer 36 shown in FIG. 6N. In the plasma treatment, only the ink-repellent layer pieces are removed because the second resin layer 52 protects the ink-repellent layer 36 from plasma.

As shown in FIG. 7Q, an adhesive layer 37 is formed by providing an adhesive or the like on the first face of the first silicon substrate 30 (the nozzle substrate 4) and the first silicon substrate 30 is then bonded to the cavity substrate 2 combined with the electrode substrate 3.

The second release layer 51 is irradiated with a laser beam or the like by applying the laser beam or the like to the second support substrate 50 in the same manner as that of the step shown in FIG. 7O, whereby the second support substrate 50 is released from the second release layer 51. The second resin layer 52 is then carefully peeled off from the first silicon substrate 30. In this operation, in the same manner as that of the step shown in FIG. 7P, an outer portion of the second resin layer 52 is first peeled off and the second resin layer 52 is then entirely peeled off from the first silicon substrate 30.

Finally, a finished substrate including the cavity substrate 2, the electrode substrate 3, and the nozzle substrate 4 bonded to one another is diced, whereby the droplet ejection head 1 is completed.

In the steps shown in FIGS. 6L to 7Q, a tape such as a dicing tape may be used instead of the first and second support substrates 40 and 50. After the first silicon substrate 30 is reduced in thickness, the first silicon substrate 30 is seriously distorted even if such a tape is attached to the first silicon substrate 30. Therefore, a face of the first silicon substrate 30 that is in contact with the tape is preferably retained with a vacuum clamping jig.

FIGS. 8 and 9 are vertical sectional views showing steps of preparing the composite plate 5 including the cavity substrate 2 and electrode substrate 3 bonded to each other. The preparation steps of the composite plate 5 will now be briefly described. Techniques for preparing the cavity substrate 2 and the electrode substrate 3 are not limited to those shown in FIGS. 8 and 9.

A glass substrate made of borosilicate glass or the like is etched with hydrofluoric acid using an etching mask made of, for example, gold or chromium, whereby fourth recessed sections 19 are formed. The fourth recessed sections 19 have a groove shape and are slightly larger than the electrodes 17.

The electrodes 17 made of ITO are formed in the fourth recessed sections 19 by, for example, sputtering.

As shown in FIG. 8*a*,a channel section 18*a* for forming the ink supply channel 18 is formed in the glass substrate with a drill or the like, whereby electrode substrate 3 is prepared.

As shown in FIG. 8B, after a first face and second face of a second silicon substrate 2*a* with a thickness of, for example, 525 μm are mirror-polished, a third silicon dioxide layer 22 with a thickness of 0.1 μm is formed on the first face of the resulting second silicon substrate 2*a* by plasma-enhanced CVD using tetraethyl orthosilicate (TEOS). Before the third silicon dioxide layer 22 is formed, a boron-doped layer functioning as an etching stopper may be formed. If the vibrating plates 12 are formed by processing the boron-doped layer, the vibrating plates 12 have a uniform thickness.

As shown in FIG. 8C, the second silicon substrate 2*a* shown in FIG. 8B is anodically bonded to the electrode substrate 3 shown in FIG. 8A in such a manner that the second silicon substrate 2*a* and the electrode substrate 3 are connected to an anode and a cathode, respectively, and heated to, for example, 360° C. and a voltage of about 800 V is applied between the second silicon substrate 2*a* and the electrode substrate 3.

As shown in FIG. 8D, the second silicon substrate 2*a* anodically bonded to the electrode substrate 3 is etched with an aqueous potassium hydroxide solution or another solution, whereby the thickness of the second silicon substrate 2*a* is reduced to, for example, 140 μm.

A TEOS layer with a thickness of, for example, 1.5 μm is formed over a second face of the second silicon substrate 2*a* that is opposite to the first face by plasma-enhanced CVD.

A resist layer for forming the following sections is formed over the TEOS layer: fifth recessed sections 13*a* for forming the ejection chambers 13, a sixth recessed section 14*a* for forming the reservoir 14, and seventh recessed sections 15*a* for forming the orifices 15. The resist layer is patterned and the TEOS layer placed thereunder is then partly etched off.

As shown in FIG. 9E, the fifth recessed sections 13*a*,the sixth recessed section 14*a*,and the seventh recessed sections 15*a* are formed in such a manner that the second silicon substrate 2*a* is etched with an aqueous potassium hydroxide solution or another solution. In this operation, a portion of the second silicon substrate 2*a* that is to be processed into an electrode-extracting section 23 is also etched so as to be reduced in thickness. In the wet etching step shown in FIG. 9E, the following solutions may be used in this order: an aqueous solution containing 35% potassium hydroxide and an aqueous solution containing 3% potassium hydroxide on a weight basis. This prevents the vibrating plates 12 from becoming rough.

After the second silicon substrate 2*a* is etched, the TEOS layer is removed from the second silicon substrate 2*a* by etching using an aqueous hydrofluoric acid solution. As shown in FIG. 9F, the channel section 18*a* is laser-processed such that the ink supply channel 18 penetrates the electrode substrate 3.

As shown in FIG. 9G, the droplet protection layer 24 made of TEOS or the like is formed on the second face of the second silicon substrate 2*a* by, for example, CVD so as to have a thickness of about 0.1 μm.

The electrode-extracting section 23 is formed by reactive ion etching (RIE) or the like so as to be open. The second silicon substrate 2*a* is machined or laser-processed such that the ink supply channel 18 extends to the sixth recessed section 14*a* through the second silicon substrate 2*a*. This leads to the completion of the composite plate 5 including the cavity substrate 2 and electrode substrate 3 bonded to each other. The composite plate 5 is bonded to the nozzle substrate 4 in the step shown in FIG. 7Q.

A sealant (not shown) for sealing a space between the vibrating plates 12 and the electrodes 17 may be provided in the electrode-extracting section 23.

In this embodiment, the recessed sections for forming the nozzles 8 are formed by etching the first face of the first silicon substrate 30, the first support substrate 40 is bonded to the first face of the first silicon substrate 30, and the second face of the first silicon substrate 30 is then processed such that the thickness of the first silicon substrate 30 is reduced. Therefore, the first silicon substrate 30 may have a large thickness when the recessed sections for forming the nozzles 8 are formed; hence, the first silicon substrate 30 can be prevented from being cracked or chipped during processing. There is no step of processing the first silicon substrate 30 reduced in thickness; hence, the first silicon substrate 30 can be effectively prevented from being cracked or chipped.

The recessed sections for forming the nozzles 8 are formed in the first silicon substrate 30 so as not to extend through the first silicon substrate 30; hence, a helium gas or another gas can be prevented from leaking to a processed face and etching failure can therefore be prevented.

The first silicon substrate 30 is bonded to the second support substrate 50, reduced in thickness, and then bonded to the cavity substrate 2; hence, the first silicon substrate 30 can be prevented from being cracked or chipped.

Second Embodiment

Figure 10:
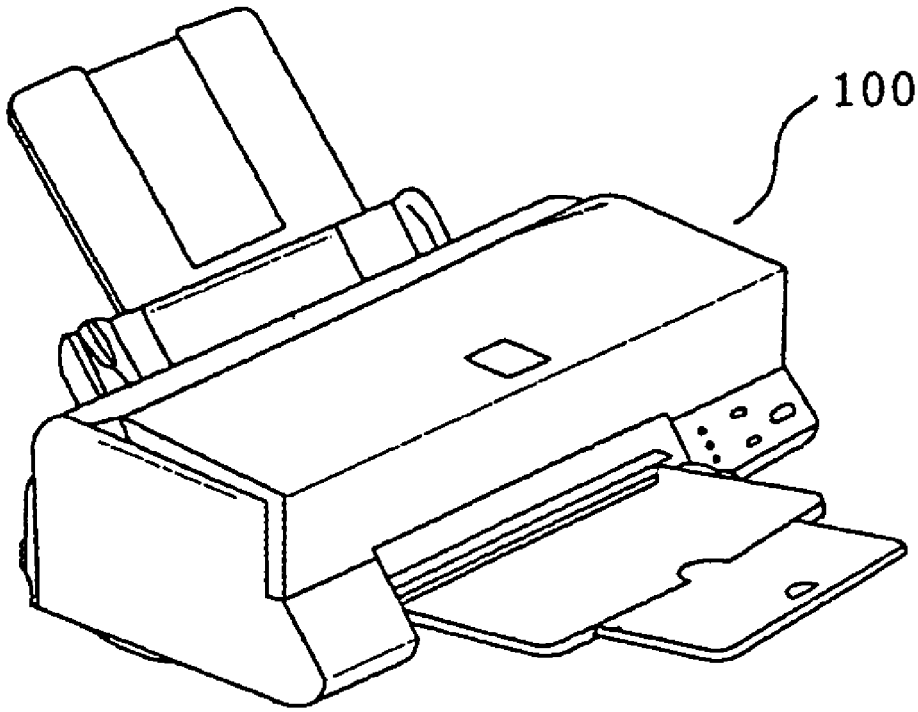
FIG. 10 is a perspective view of an exemplary droplet ejection apparatus including a droplet ejection head manufactured by the method according to the first embodiment.

FIG. 10 is a perspective view of an exemplary droplet ejection apparatus 100 including a droplet ejection head 1 manufactured by the method according to the first embodiment. The droplet ejection apparatus 100 shown in FIG. 10 is an ordinary inkjet printer.

The droplet ejection head 1 has no cracks or defects; hence, the droplet ejection apparatus 100 has high ejection performance.

The droplet ejection head 1 can be used for various applications, other than the inkjet printer, such as the manufacture of color filters for liquid crystal displays, the preparation of light-emitting sections of organic electroluminescent display systems, and the ejection of bioliquid by changing the type of liquid ejected from the droplet ejection head 1.

The droplet ejection head 1 can be used for piezoelectric droplet ejection apparatuses or bubble jet® type droplet ejection apparatuses.

A method for manufacturing a droplet ejection head, droplet ejection head, and droplet ejection apparatus according to the present invention are not limited to the embodiments of the present invention. Various modifications may be made within the scope of the present invention. A nozzle substrate 4 may be prepared using a first support substrate 40 only without using a second support substrate 50.

What is claimed is:

1. A method for manufacturing a droplet ejection head, comprising:

a step of forming recessed sections for forming nozzles by etching half-way through a first face of a silicon substrate;

a step of bonding a support substrate to the first face of the silicon substrate;

a step of reducing the thickness of the silicon substrate by processing a second face of the silicon substrate that is opposite to the first face thereof, and making the recessed sections through holes;

a step of forming an ink-resistant protective layer and an ink-repellent layer on the second face of the silicon substrate, this step being performed subsequently to the step of reducing the thickness of the silicon substrate;

a step of bonding a second support substrate or a tape to the second face of the silicon substrate; and a step of removing the first support substrate from the silicon substrate in such a state that the second support substrate or the tape is bonded to the silicon substrate.

2. The method according to claim 1, wherein the walls of the nozzles are plasma-treated in such a state that the second support substrate or the tape is bonded to the silicon substrate.

3. The method according to claim 1, further comprising a step of bonding the silicon substrate to a cavity substrate having recessed sections for forming ejection chambers in such a state that the second support substrate or the tape is bonded to the silicon substrate and a step of removing the second support substrate or the tape from the silicon substrate bonded to the cavity substrate.

4. A method for manufacturing a droplet ejection head, comprising;

a step of forming recessed sections for forming nozzles by etching half way through a first face of a silicon substrate;

a step of bonding a first support substrate to the first face of the silicon substrate;

a step of reducing the thickness of the silicon substrate by processing a second face of the silicon substrate that is opposite to the first face thereof, and making the recessed sections through holes;

a step of bonding a second support substrate or a tape to the second face of the silicon substrate; and a step of removing the first support substrate from the silicon substrate in such a state that the second support substrate or the tape is bonded to the silicon substrate;

wherein the walls of the nozzles are plasma-treated in such a state that the second support substrate or the tape is bonded to the silicon substrate.

5. A method for manufacturing a droplet ejection head, comprising:

a step of forming recessed sections for forming nozzles by etching half way through a first face of a silicon substrate;

a step of bonding a first support substrate to the first face of the silicon substrate;

a step of reducing the thickness of the silicon substrate by processing a second face of the silicon substrate that is opposite to the first face thereof, and making the recessed sections through holes;

a step of bonding a second support substrate or a tape to the second face of the silicon substrate;

a step of removing the first support substrate from the silicon substrate in such a state that the second support substrate or the tape is bonded to the silicon substrate;

a step of bonding the silicon substrate to a cavity substrate having recessed sections for forming ejection chambers in such a state that the second support substrate or the tape is bonded to the silicon substrate; and a step of removing the second support substrate or the tape from the silicon substrate bonded to the cavity substrate.

6. A method for manufacturing a droplet ejection head, comprising:

a step of forming recessed sections for forming nozzles by etching a first face of a silicon substrate;

a step of bonding a support substrate to the first face of the silicon substrate;

a step of reducing the thickness of the silicon substrate by processing a second face of the silicon substrate that is opposite to the first face thereof;

a step of forming an ink-resistant protective layer and an ink-repellent layer on the second face of the silicon substrate, this step being performed subsequently to the step of reducing the thickness of the silicon substrate; and a step of bonding a second support substrate or a tape to the second face of the silicon substrate and a step of removing the support substrate from the silicon substrate in such a state that the second support substrate or the tape is bonded to the silicon substrate.

7. The method according to claim 6, wherein the walls of the nozzles are plasma-treated in such a state that the second support substrate or the tape is bonded to the silicon substrate.

8. The method according to claim 6, further comprising a step of bonding the silicon substrate to a cavity substrate having recessed sections for forming ejection chambers in such a state that the second support substrate or the tape is bonded to the silicon substrate and a step of removing the second support substrate or the tape from the silicon substrate bonded to the cavity substrate.

9. A method for manufacturing a droplet ejection head, comprising:

a step of forming recessed sections for forming nozzles by etching a first face of a silicon substrate;

a step of bonding a first support substrate to the first face of the silicon substrate;

a step of reducing the thickness of the silicon substrate by processing a second face of the silicon substrate that is opposite to the first face thereof;

a step of bonding a second support substrate or a tape to the second face of the silicon substrate; and a step of removing the first support substrate from the silicon substrate in such a state that the second support substrate or the tape is bonded to the silicon substrate, wherein the walls of the nozzles are plasma-treated in such a state that the second support substrate or the tape is bonded to the silicon substrate.

10. The method according to claim 9, further comprising a step of bonding the silicon substrate to a cavity substrate having recessed sections for forming ejection chambers in such a state that the second support substrate or the tape is bonded to the silicon substrate and a step of removing the second support substrate or the tape from the silicon substrate bonded to the cavity substrate.

* * * * *